US006861605B2

(12) United States Patent
Wong

(10) Patent No.: US 6,861,605 B2
(45) Date of Patent: Mar. 1, 2005

(54) ELECTRICAL SLIDE SWITCH

(75) Inventor: Kin Yu Wong, Chaiwan (HK)

(73) Assignee: Defond Manufacturing Limited, Chaiwan (HK)

( * ) Notice: Subject to any disclaimer, the term of this patent is extended or adjusted under 35 U.S.C. 154(b) by 0 days.

(21) Appl. No.: 10/309,357

(22) Filed: Dec. 4, 2002

(65) Prior Publication Data

US 2004/0108190 A1 Jun. 10, 2004

(51) Int. Cl.[7] ..... Y01H 15/06

(52) U.S. Cl. ..... 200/550; 200/531; 200/541; 200/261

(58) Field of Search ..... 200/548–550, 200/260, 531, 541, 563

(56) References Cited

U.S. PATENT DOCUMENTS 2,183,892 A * 12/1939 Pitsch ..... 200/550
3,336,556 A * 8/1967 Henriksen ..... 200/260
4,001,526 A * 1/1977 Olson ..... 200/531
4,311,885 A * 1/1982 Arthur ..... 200/548
6,118,234 A * 9/2000 Marcellus et al. ..... 200/563

* cited by examiner

*Primary Examiner*—Renee Luebke
(74) *Attorney, Agent, or Firm*—Leydig, Voit & Mayer, Ltd.

(57) ABSTRACT

An electrical switch includes an operating member carrying moving contacts which face, in opposite directions, two rows of fixed contacts. The operating member moves the moving contacts into and out of contact with the fixed contacts. Each moving contact may have opposite ends for contacting two adjacent fixed contacts on a corresponding side of the operating member. Springs provided between the moving contacts and corresponding side of the operating member bias the contact ends into contact with the corresponding rows of fixed contacts.

8 Claims, 3 Drawing Sheets

ELECTRICAL SLIDE SWITCH

The present invention relates to an electrical switch for controlling the operation of an electrical appliance.

BACKGROUND OF THE INVENTION

Electrical switches of the type concerned are known, i.e. having two rows of fixed contacts located in a casing and a pair of moving contacts movable by an operating member to make and break electrical connection between the fixed contacts of each row. In one construction, the operating member, together with the moving contacts, usually rides on the fixed contacts, which in general has been in use for a long time especially for slide switches. One of the problems lies in the smoothness of travel of the operating member.

The invention seeks to provide an improved electrical switch of this type in general.

SUMMARY OF THE INVENTION

According to the invention, there is provided an electrical switch comprising a casing, two rows of fixed contacts located within the casing and on opposite sides thereof, and a moving contact for making and breaking an electrical connection between the fixed contacts of each row. An operating member is provided between the two rows of fixed contacts. The operating member is supported by the casing for relative movement along a path co-extensive with the two rows of fixed contacts to move the moving contacts into contact with and out of contact with the fixed contacts of the corresponding rows. The moving contacts are carried by the operating member on opposite sides thereof for movement thereby, facing, in opposite directions, the two rows of fixed contacts.

Preferably, the moving contacts are resiliently biased in opposite directions from each other into contact with the corresponding rows of fixed contacts.

More preferably, a spring is provided between each moving contact and the corresponding side of the operating member and resiliently basses the moving contact from the operating member.

Even more preferably, each moving contact has opposite ends for contacting two adjacent fixed contacts of the corresponding row, and each contact end is subject to the bias of a respective spring.

It is preferred that the operating member has a recess in each of its opposite sides, locating therein the corresponding moving contact.

In another preferred embodiment the operating member has located therein the corresponding moving contact and associated spring.

In a preferred embodiment, the operating member includes a box-like structure within the casing, the structure having opposite sides that are open and a central partition dividing the two sides into respective recesses that locate the corresponding moving contacts by partially containing them.

More preferably, each moving contact substantially closes the corresponding open side of the structure.

As a preferred example, the casing has an oblong shape including a linear longitudinal axis, on opposite sides of which the two rows of fixed contacts are arranged and along which the operating member is slidable.

In a specific construction, the casing has a lower part and an upper part secured with the lower part, and each fixed contact has lower and upper ends in engagement with the lower and upper casing parts respectively for location thereby.

More specifically, the lower end of the fixed contact protrudes out through a hole of the lower casing part, and the upper end is engaged by a void of the upper casing part.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
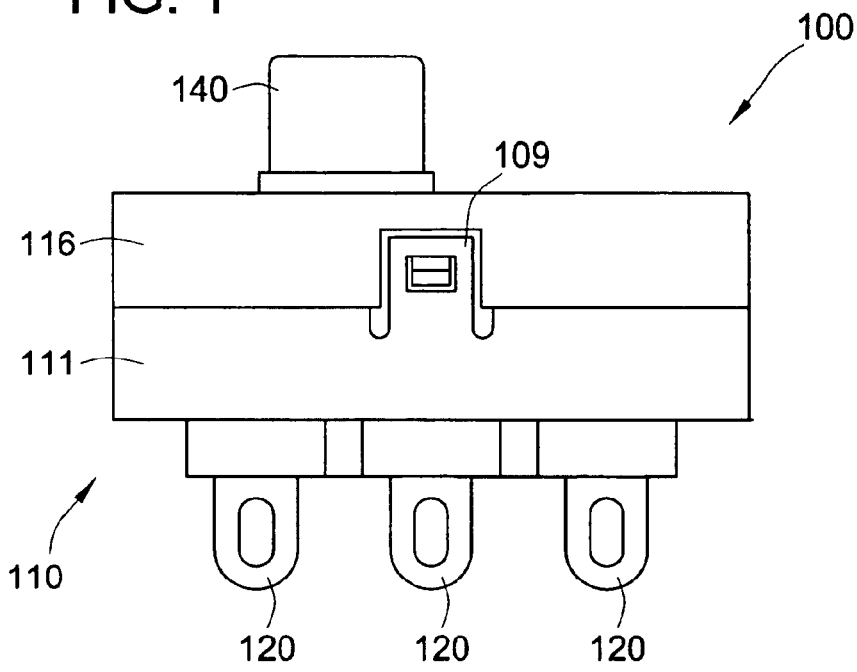
FIG. 1 is a side view of an embodiment of an electrical switch in accordance with the invention.
Figure 2:
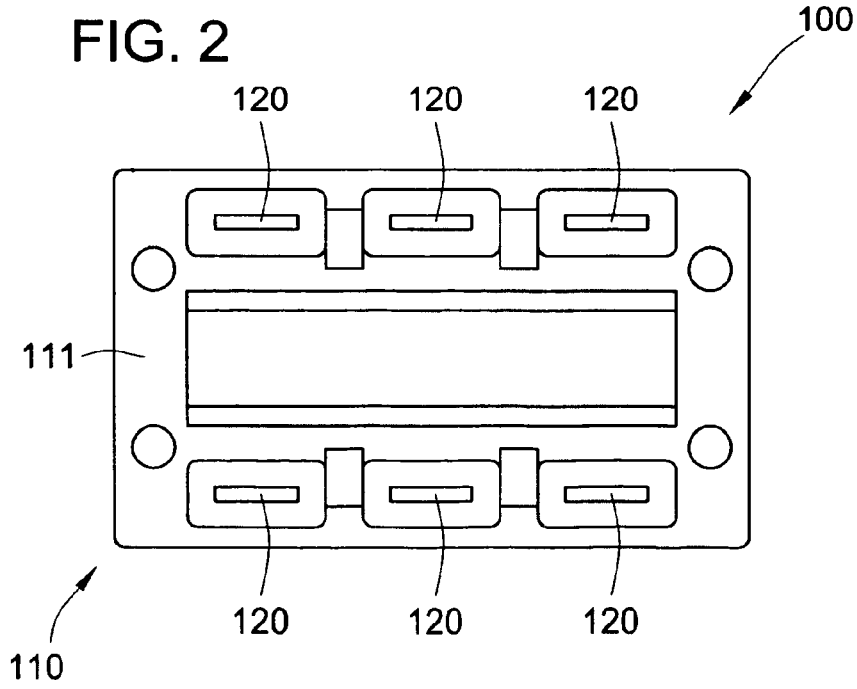
FIG. 2 is a bottom plan view of the switch of FIG. 1.
Figure 3:
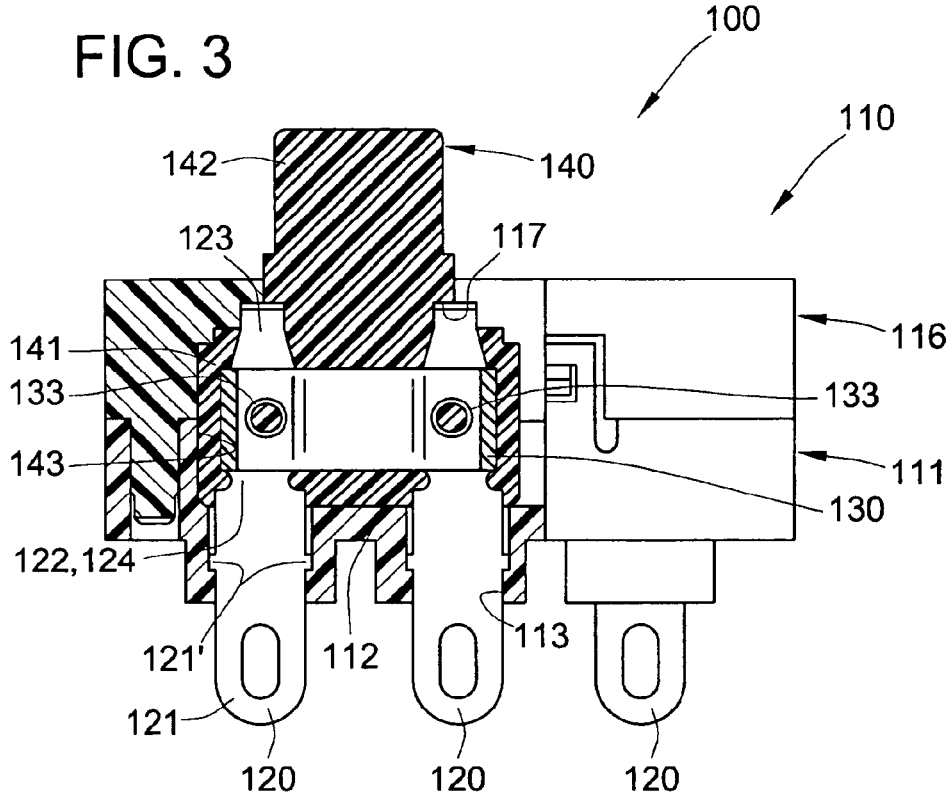
FIG. 3 is a partially cross-sectional side view of the switch of FIG. 1.
Figure 4:
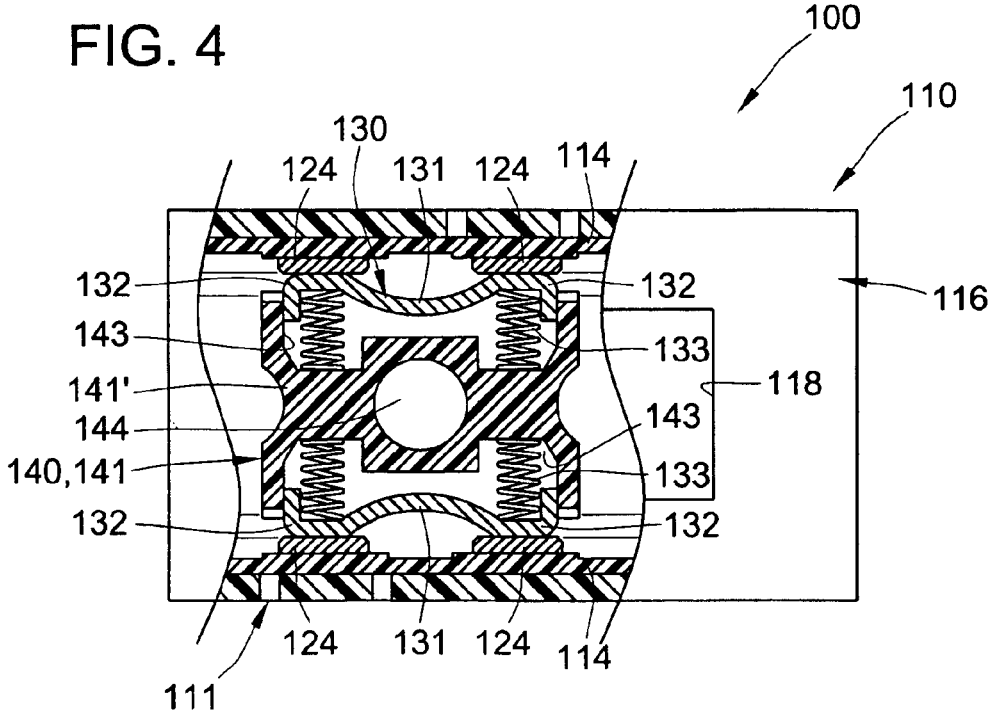
FIG. 4 is a partially cross-sectional top view of the switch of FIG. 1.
Figure 5:
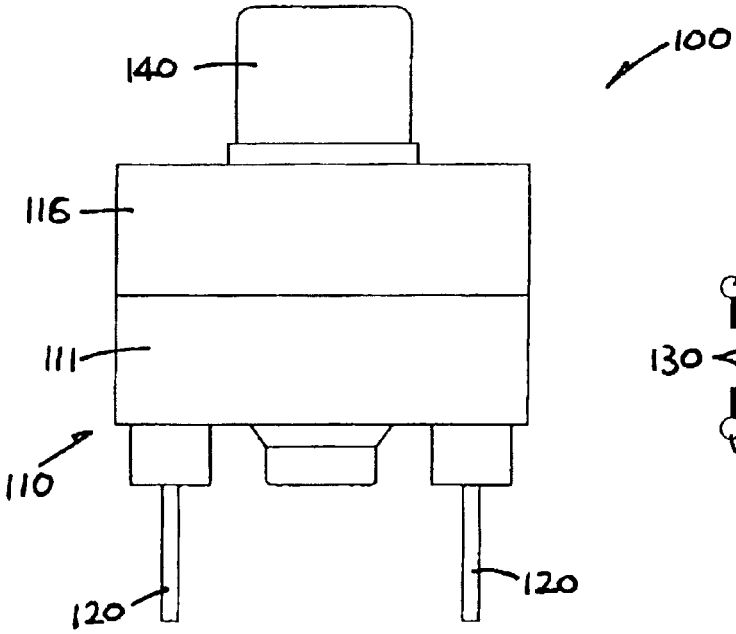
FIG. 5 is an end view of the switch of FIG. 1.
Figure 7:
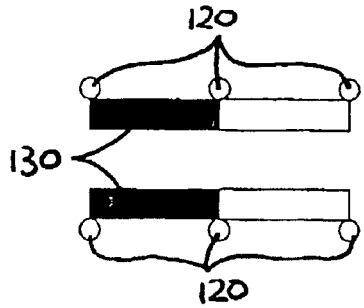
FIG. 7 is a schematic switching diagram of the switch of FIG. 1.
Figure 6:
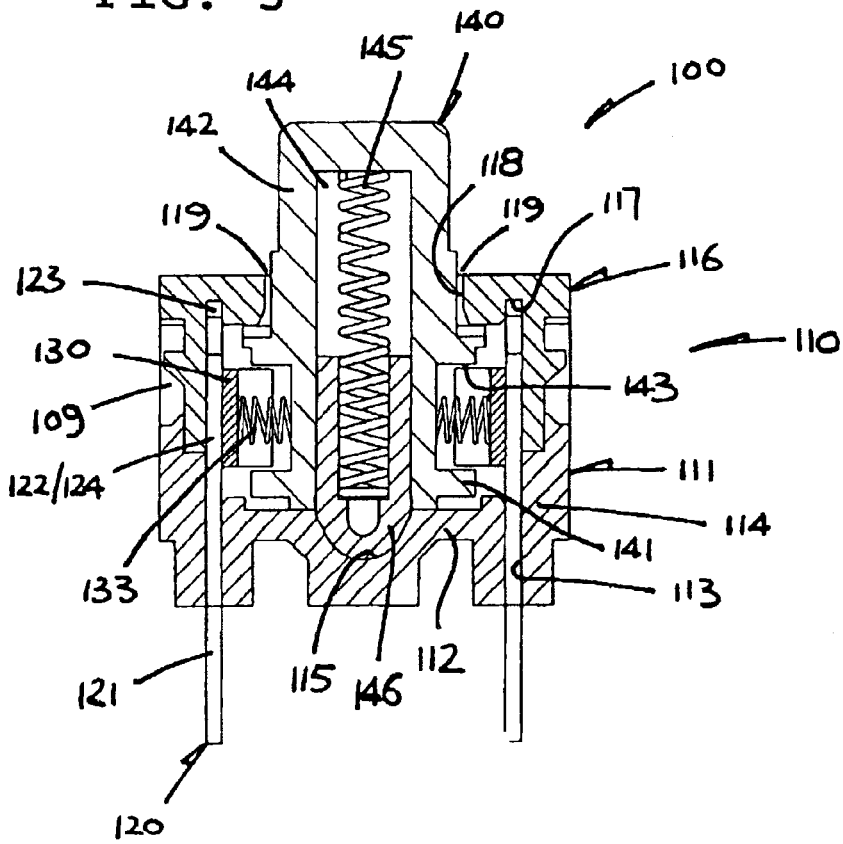
FIG. 6 is a cross-sectional end view of the switch of FIG. 1.

Referring to the drawings, there is shown an electrical switch in the form of a slide switch 100 embodying the invention. The switch 100 has an oblong, generally rectangular plastic casing 110 formed by a base 111 and a lid 116, and includes two rows of switch terminals 120, each row having three switch terminals 120, fixed to the casing 110. The lid 116 closes onto the base 111 and is secured therewith by a pair of snap connectors 109 on opposite oblong sides. The terminals 120 pass vertically through a bottom wall 112 of the base 111, and are arranged at regular intervals on opposite left and right sides of a longitudinal axis of the casing 110.

Each terminal 120 is provided by a straight copper strip having a lower end 121, a middle section 122 and an upper end 123. The lower end 121 projects out through an associated bottom slot 113 of the base 111 for external electrical connection, including a pair of shoulders or side lugs 121' anchoring behind the slot 113. The lid 116 engages, by means of a relevant recess 117, the upper end 123 from above, whereby the terminal 120 is fixed by and between the lid 116 and the base 111. The middle section 122 lies against the inner surface of an associated side wall 114 of the base 111, acting as a respective fixed contact 124.

The switch 100 includes an upright operating member 140 housed partially in the casing 110 between the two rows of fixed contacts 124, which carries a pair of internal moving contacts 130 on opposite left and right sides thereof. The moving contacts 130 are arranged to face the corresponding rows of fixed contacts 124 in opposite directions, for making and breaking electrical connection between them on each side. The operating member 140 is supported by the casing 110 for relative sliding movement in opposite directions along a linear path for bringing the moving contacts 130 into contact with and out of contact from the fixed contacts 124. The sliding path extends along the longitudinal axis of the casing 110, co-extensive with the two rows of fixed contacts 124.

A lower portion 141 of the operating member 140 is enclosed within the casing 110, while its upper portion 142 is relatively smaller in cross-section and projects out through a longitudinally extending slot 118 of the lid 116. The exposed upper portion 142 acts as a knob, by which the operating member 140 can be slid. The lower portion 141 is a generally rectangular box-like structure having opposite left and right open sides and a central partition 141' dividing the two sides into and thus forming respective recesses 143.

Each moving contact 130 is provided by a horizontally extending copper strip which is bent into a generally flat M-shape, having a pair of 90° turned opposite ends 132 and a curved middle section 131. The moving contact 130 is slightly smaller than and is contained partially within the corresponding recess 143, extending across the recess opening and with its opposite ends 132 pointing and its middle section 131 facing inwards, thereby substantially closing the recess 143.

Two horizontal coil springs 133 are compressed between respective ends 132 of each moving contact 130 and the bottom of the corresponding recess 143. The two springs 133 resiliently bias the moving contact 130 outwardly from the recess 143 and, in particular, individually urge the corresponding contact ends 132 against aligned fixed contacts 122 on the same side of the casing 110.

The overall operating member 140 is hollow, including an inverted vertical central blind bore 144 that extends upwards across the lower portion 141 into the upper portion 142. The bore 144 houses a compression coil spring 145 and a plunger 146 that is urged by the spring 145 to protrude partially out of an open bottom end of the bore 144. The lowermost end of the plunger 146 is round.

The bottom wall 112 of the base 111 is formed with a longitudinally extending central track 115 having a wavy or, more specifically, W-shaped upper surface, against which the plunger 146 bears by its lowermost end under the resilient action of the spring 145. The plunger 146 rides up and down on and along the track 115 upon sliding of the operating member 140. The track 115 has two valleys that can retain the plunger 146, thereby defining respective stable positions for the operating member 140, at either of which each moving contact 130 bridges across an aligned pair of adjacent fixed contacts 124 on that side.

The operating member 140 and the two moving contacts 130 including the four springs 133 between them together are flanked by and co-act between the two row of fixed contacts 124. The moving contacts 130 are urged by the springs 133 outwardly in opposite directions against the fixed contacts 124, while the operating member 140 is being acted upon symmetrically by the springs 133 on opposite sides.

Given that play is inevitable in the assembly, such as in particular small gaps 119 between the operating knob 142 and the slot 118 around it, the operating member 140 is able to shift to the left and right albeit to a limited extent. With the operating member 140 being acted upon on opposite sides by the springs 133, the force of the springs 133 is automatically evenly distributed or balanced between the left and right sides in normal condition. This facilitates sliding of the operating member 140, thereby rendering the movement more smooth.

The invention has been given by way of example only, and various modifications of and/or alterations to the described embodiment may be made by persons skilled in the art without departing from the scope of the invention as specified in the appended claims.

What is claimed is:

1. An electrical switch comprising:

a casing;

two rows of fixed contacts located within the casing and on opposite sides thereof;

a moving contact for making and breaking an electrical connection between the fixed contacts of each row, each moving contact having opposite ends for contacting two adjacent fixed contacts of the corresponding row, and a curved middle section between the opposite ends;

an operating member provided between the two rows of fixed contacts and supported by the casing for relative movement along a path co-extending with the two rows of fixed contacts, the operating member carrying the moving contacts on opposite sides thereof, facing, in opposite directions, the two rows of fixed contacts to move the moving contacts into contact with and out of contact with the fixed contacts of the corresponding rows; and a spring provided between each opposite end of each moving contact and the corresponding side of the operating member resiliently biasing the moving contacts in opposite directions from each other and resiliently biasing each opposite end of the moving contact from the operating member.

2. The electrical switch as claimed in claim 1, wherein the operating member has a recess in each of its opposite sides, locating therein the corresponding moving contact.

3. The electrical switch as claimed in claim 1, wherein the operating member has a recess in each of its opposite sides, locating therein the corresponding moving contact and associated spring.

4. The electrical switch as claimed in claim 1, wherein the operating member includes a box-like structure within the casing, the structure having opposite sides that are open and a central partition dividing the two sides into respective recesses that locate the corresponding moving contacts by partially containing them.

5. The electrical switch as claimed in claim 4, wherein each moving contact substantially closes the corresponding open side of the structure.

6. The electrical switch as claimed in claim 1, wherein the casing has an oblong shape including a linear longitudinal axis, on opposite sides of which the two rows of fixed contacts are arranged and along which the operating member is slidable.

7. The electrical switch as claimed in claim 1, wherein the casing has a lower part and an upper part secured with the lower part, and each fixed contact has lower and upper ends in engagement with the lower and upper casing parts, respectively, for location thereby.

8. The electrical switch as claimed in claim 7, wherein the lower end of the fixed contact protrudes out through a hole of the lower casing part, and the upper end is engaged by a void of the upper casing part.

* * * * *